US011371800B1

(12) United States Patent
Woodward

(10) Patent No.: US 11,371,800 B1
(45) Date of Patent: Jun. 28, 2022

(54) SPECIFICALLY ADJUSTED WORKINGS NUNCHAKU ASSEMBLY METHOD

(71) Applicant: Steven Woodward, North Chesterfield, VA (US)

(72) Inventor: Steven Woodward, North Chesterfield, VA (US)

( * ) Notice: Subject to any disclaimer, the term of this patent is extended or adjusted under 35 U.S.C. 154(b) by 0 days.

(21) Appl. No.: 16/742,843

(22) Filed: Jan. 14, 2020

(51) Int. Cl.
*A63B 59/00* (2015.01)
*F41B 15/00* (2006.01)
*A63B 69/00* (2006.01)

(52) U.S. Cl.
CPC ..... *F41B 15/00* (2013.01); *A63B 69/004* (2013.01)

(58) Field of Classification Search
None
See application file for complete search history.

(56) References Cited

U.S. PATENT DOCUMENTS 3,454,274 A * 7/1969 Kaneshiro ..... A63F 7/382 463/47.5
3,937,468 A * 2/1976 Conde, Sr. ..... A63B 69/004 463/47.5
4,070,023 A 1/1978 Cutler
4,155,551 A 5/1979 Smith
D274,928 S * 7/1984 Orcutt ..... D22/117
6,126,292 A 10/2000 Liu
6,299,537 B1 10/2001 Clowser
7,086,951 B2 8/2006 Chang

* cited by examiner

*Primary Examiner* — Sunit Pandya

(57) ABSTRACT

A manner of manufacturing a modernized nunchuck using specifically adjusted workings or saw process construction methods, facilitating a better fit and functions for the nunchuck, while increasing levels of safety and precision operations for users. The nunchuck includes a first and second grip handle, having a top and bottom end. The top ends machined with a quarter rounded edge to minimize resistance against movement. A single cord configuration includes a flexible coupling having alike end accommodated and fixed in place by a coupling anchor and anchor support at top end of first and second grip handles. Anchor support also functions as a handle grip guide assisting precise and consistent hand placement during use of the saw nunchuck. Each bottom end comprises an optical stripe, providing a variety of light reflections for improved ocular functions and visual effects enhancing user performance.

1 Claim, 6 Drawing Sheets

FIG. 6
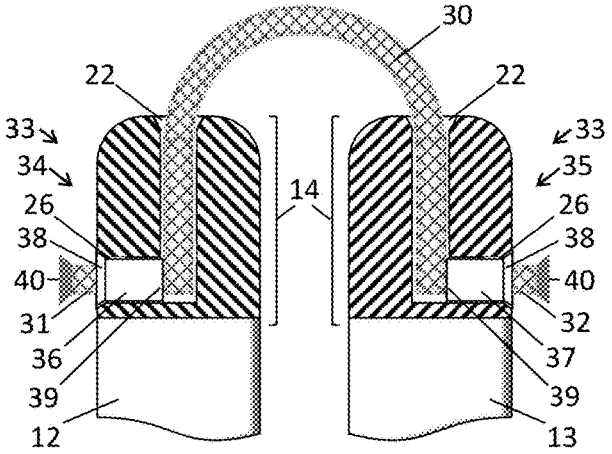
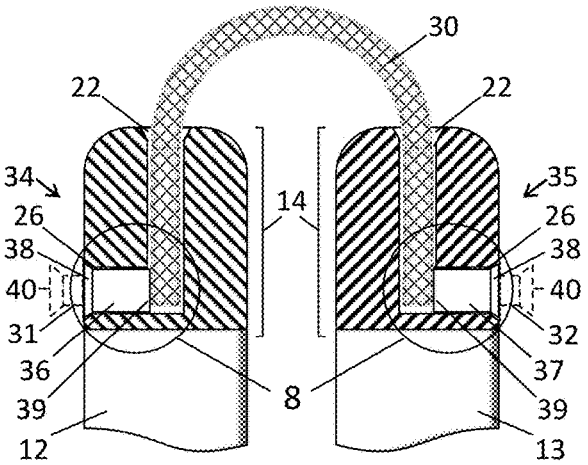
FIG. 7
FIG. 8
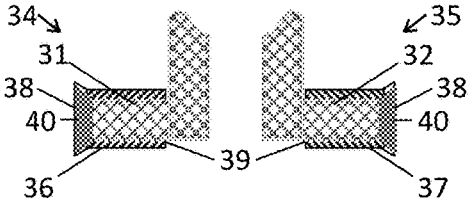
FIG. 8A
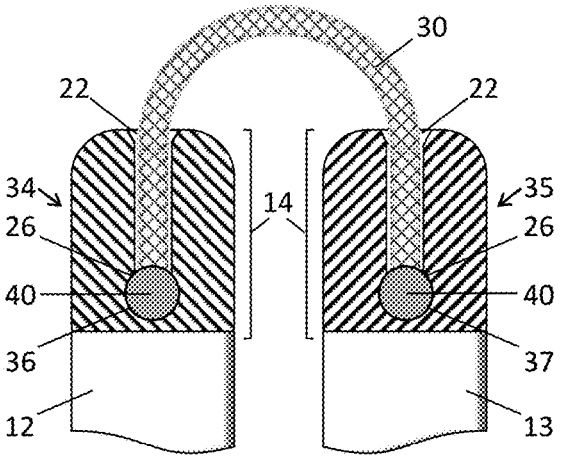

SPECIFICALLY ADJUSTED WORKINGS NUNCHAKU ASSEMBLY METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON COMPACT DISC

Not Applicable

STATEMENT REGARDING PRIOR DISCLOSURES BY THE INVENTOR

Not Applicable

BACKGROUND ART

The following is a tabulation of some art indicated by the cited documents which, as far as is known to the applicant, presently appear relevant and useful to understand the embodiments.

Documents Cited

| Pat. No. | Kind Code | Issue Date | Patentee |
|---|---|---|---|
| 6,299,537 | B1 | Oct. 9,2001 | Clowser |
| 7,086,951 | B2 | Aug. 8, 2006 | Chang |
| 6,126,292 | A | Oct. 3, 2000 | Liu |
| 3,937,468 | | Feb. 10, 1976 | Conde, Sr. |
| 4,070,023 | | Jan. 24, 1978 | Cutler |
| 4,155,551 | | May 22, 1979 | Smith |

The embodiment relates to a nunchaku training weapon, and particularly to an assembly method for manufacturing a nunchaku with an advanced construction process providing a better user fit and functions, facilitating higher levels of safety and precision performance.

The nunchaku is a traditional Okinawan martial arts weapon initially used as a farm tool that was expanded into combat use. Now nunchaku are primarily utilized as a training weapon in the martial arts Okinawan Kobudo, Filipino Kali and Karate. It is one of the first weapons that many martial arts students learn how to use for further development of their skills.

It is known that conventional nunchaku are normally made of two cylindrical or octagonal handles, attached with a two-strand cord or a metal chain, usually measuring from 7.62 to 15.24 cm (3 to 6 inches) in length. The handles are typically made of either a heavy hardwood such as oak or a high-density polypropylene plastic or some type of metal, generally measuring 30.48 or 35.56 cm (12 or 14 inches) in length and 2.54 to 3.17 cm (1 to 1¼ inches) in diameter. Making conventional nunchaku with these specifications, is basically providing a "one size fits all" nunchaku, capable of creating restrictions and limitations on its potential use.

I have found that many of the people belonging to one of the largest consumer groups of potential users will be restricted or limited in some way, due to certain user factors and safety issues. According to statistics from the Sporting Goods Manufacturers Association, children ages 6 to 17 years old account for almost half of the participants in martial arts. The IBIS World Industry Research Report states that in 2019, consumers under the age of 17 are expected to generate 55.7% of industry revenue. Taking this group of potential users into consideration, some of the known nunchaku will have inherent disadvantages:

(a) Shape of Handles: cylindrical shaped handles provide a higher level of safety compared to octagonal shaped handles with a design of eight congruent sides and angles running vertically the full length of the handles. The top edges of the angles have a smaller striking surface capable of producing deeper penetrating impact shock waves, as well as cutting flesh. The primary safety issue concerning use of octagonal handles, is the higher risk of serious injury resulting from accidental contact. Due to this safety concern, many beginners would be restricted from participation, therefore limiting usage of the octagonal shaped nunchaku to intermediate and advance level students.

(b) Type of Connection: the most commonly used connection is either a two-strand cord or a metal chain, usually measuring from 7.62 to 15.24 cm (3 to 6 inches) in length. Some disadvantages of the two-strand cord connection are: the standard nylon cord is not built with a protective cover, which makes it more susceptible to wear and breakage. The two strands of cord create a fluctuation in movement during rotation that affects function performance. The connection system configuration increases production time, due to the required amount of machining. Some disadvantages of the metal chain connection are that the metal chain and the ball bearing devices add to the overall weight of the nunchaku, thereby having an affect on determining the level of safety and function performance. Additionally, the connection length affects the degree of difficulty in controlling and handling the nunchaku. The longer the length, the greater the increase in level of difficulty to control the nunchaku, thereby producing a greater decrease in the level of safety.

(c) Type of Materials: weight of handles is the number one source of contributing factors that influence the outcome of function performance and level of safety. Referring to factors affecting motion, "The heavier the object, the more force needed to make it move." If the handle is heavy, it is harder to start movement, stop movement and change direction of movement. Heavy weight increases resistance on motion affecting performance of functions. The disadvantages created include a decrease in stability of motion with an increased level of physical exertion needed for movement. Heavy handles also generate higher impact force shock waves, which increases the risk of serious injury from accidental contact.

(d) Size of Handles: handles usually measure 30.48 or 35.56 cm (12 or 14 inches) in length and 2.54 to 3.17 cm (1 to 1¼ inches) in diameter. Length and diameter of handles also affects overall weight of the nunchaku. The disadvantage is an increased level of resistance on motion, making it harder to control the nunchaku, causing higher risk of injury from accidental contact. Another disadvantage for consideration is that due to specific user factors (hand size, arm length, and overall strength) many of the people in the 6-17 years old consumer group of potential users or any adult affected by these user factors may be restricted or limited in using the conventional nunchaku because of possible safety issues and unavailable solutions to the above disadvantages.

Accordingly, it would be advantageous to provide a nunchaku assembly method that would make a modern-day nunchuck with an advanced process of construction methods, using precise and detailed adjustments designed to attain refined foundational properties, enabling a better fit and functions for the nunchuck and the user. It would also be advantageous to provide a nunchaku assembly method that would:

- address the disadvantages of the conventional nunchaku described in the section above;
- reduce restrictions and limitations placed on potential users by some of the known conventional nunchaku;
- use a metal lathe to provide a machining method for making a nunchaku with an advanced construction wherein machining processes are substantially minimized, and refined foundational properties are attained for a better fit and functions;
- streamline and improve efficiency of the production steps used in manufacturing, which reduces the cycle time of production and the amount of labor required for production:
- reduce the costs of materials and labor, causing the manufacturing cost per unit to be lower, making the nunchaku economically available to the consumer;
- provide the user a means for higher levels of safety and precision performance with an available alternative solution to the disadvantages of the conventional nunchaku.

BRIEF SUMMARY OF THE EMBODIMENT

The embodiment is a specifically adjusted workings (saw) nunchaku assembly method for manufacturing a saw nunchuck, using saw process construction methods of precise and detailed adjustments to refine foundational properties, enabling a better fit and functions for the saw nunchuck and the user. A detailed description of saw process will follow below. The saw nunchaku assembly method of making a nunchuck comprises a set of grip handles or dowel rods including a top end and a bottom end, each top end has a top end side with a top face, and each bottom end has a bottom end side with a bottom edge. A quarter rounded edge is machined on top face of each top end to restrict surface contact and minimize friction between a flexible coupling and each top face of the first and second grip handles during operation of the saw nunchuck. A connection system comprises a connection components and anchor components, used in a single cord configuration to enclose and fix in position a first alike end and a second alike end of the flexible coupling within each of the top ends, such that the flexible coupling is joined to each of the first and second grip handles by accommodating each first and second alike end, fixed in position at each top end side, respectively. An anchor support is used to further reinforce each first and second alike end of the flexible coupling at each top end side of each first and second grip handle. The anchor support also functions as a handle grip guide including an easy to find grip position for assisting precise and consistent hand placement, providing the user a means for developing better control and more reliable handling during use of the saw nunchuck. Each of the bottom ends includes an optical stripe comprising a silver metal stripe and a prismatic stripe affixed on the bottom end side, flush with the bottom edge of each first and second grip handle. The optical stripes generate a variety of light reflections for improved ocular functions and visual effects enhancing user performance.

The general purpose of the embodiment is to provide a specifically adjusted workings (saw) nunchaku assembly method for manufacturing a modernized saw nunchuck, using saw process construction methods to attain refined foundational properties that facilitate a better fit and functions for the saw nunchuck, allowing increased levels of safety and precision performance for the user.

The saw process refers to construction methods of precise and detailed adjustments based on interactions between the corresponding parts of primary components constructed to provide a better fit enabling better functions for the saw nunchuck. The interactions between primary components and user factors (hand size, arm length, strength) are also used to provide a better user fit facilitating a better user operation performance. Primary components include a first grip handle, a second grip handle and a cord or flexible coupling having alike ends that are manufactured with saw process construction methods encompassing the features listed below.

a) Hardwood Construction—updated materials for manufacturing grip handles; made from wood dowel rod that is very lightweight, sturdy and durable with excellent machinability.

b) Machining Methods—updated machining process using a metal lathe to provide a precision method of fabricating a grip handle from a wood dowel rod for a saw nunchuck with an advanced construction wherein machining processes are substantially minimized and refined foundational properties are attained for a better fit and functions.

c) Sizing Method—updated handle sizes in accordance with a saw process: using wood dowel rods machined on lathe to standard sizes ranging from about 25.4 to 30.48 cm (10" to 12") length and 1.9 to 2.54 cm (¾" to 1") diameter to provide users with a better fit and functions.

d) Quarter Round Method—machined straight edge cut on top face of grip handles to a quarter rounded edge; substantially restricts surface contact and minimizes friction between flexible coupling and top face of grip handles, Quarter rounded edge specifically sized and shaped to restrict outside edge of top face from contacting coupling, thereby decreasing resistance to motion and wear on the coupling. Permits smoother rotation with less exertion for movement, allowing easier control and better handling.

e) Connection System Method—updated method with reduced build time using a single cord configuration at top end of grip handles: includes a coupling inlet on the top face, having a centered vertical blind hole with a bevel edge; vertical blind hole specifically sized for flexible coupling fitted tightly therein to substantially restrict and control movement between outside diameter of coupling and inside diameter of inlet, thereby decreasing resistance and wear on coupling, permitting smoother rotation with less exertion, allowing easier control and better handling.

f) Precision Balance Method—updated method weigh and match grip handles in pairs and sets, using tolerance specifications according to the saw process; increases stability and consistency in movements with less exertion, allowing easier control and better handling.

g) Cord Connect—updated connection configuration uses a single kernmantle constructed cord. Kernmantle cord is made with a separate internal core (kern) and external sheath (mantle) for optimum strength, durability and flexibility. The internal core is built from continuous strands of nylon fibers that provide the tensile strength of the cord. The nylon woven external sheath protects core strands from abrasion and damage. Kernmantle cord helps reduce resistance on motion, allows smoother rotation with less exertion needed for movement, permitting easier control and more reliable handling for the user.

h) Cord Size—updated flexible coupling sizes include a larger diameter and a shorter length: the flexible coupling diameter is specifically sized for being fitted tightly within coupling inlets; is designed to substantially restrict and control movement between the flexible coupling outside diameter and inside diameter of the inlet, thereby decreasing resistance and wear on coupling. Shorter coupling length produces smaller rotation patterns with less exertion needed for movement, allowing easier control and more reliable handling for the user.

i) Anchor Method—updated method having a reduced production time, for anchoring each first and second alike ends of coupling at top end side of first and second grip handles: anchor components include a coupling outlet on top end side, having a horizontal blind hole with a bevel edge; designed to enclose and fix in place a coupling anchor comprising a sleeve fastener having a flared and tapered end. The outlet specifically sized to tapered end fitted tightly therein, until the flared end is flush with bevel edge so to prevent movement of sleeve fastener. The tapered end specifically sized to an alike end fitted tightly within the fastener. Flared end specifically sized to an alike end with a fixed end fitted tightly therein and further reinforced with an anchor support at top end side of first and second grip handles so to prevent movement of the coupling anchor.

j) Handle Grip Guide—anchor support also functions as a handle grip guide; with an easy to find grip position supporting precise and consistent hand placement, providing the user a means for developing better control and more reliable handling during use of the saw nunchuck.

k) Optical Stripes—use of metal and prism tapes at bottom end of grip handle, generates a variety of light reflections for improved ocular functions including faster visual acquisition, better eye retention in visual tracking, and visual effects enhancing user performance.

Advantages

A first advantage is a saw nunchaku assembly method for manufacturing a modernized saw nunchuck, using a saw process of construction methods for attaining refined foundational properties enabling a better fit and functions, allowing higher levels of safety and precision performance, facilitating accelerated development and improvement of skills for users.

A second advantage is a saw nunchuck using a sizing specifications process based on interactions between primary components and user factors for attaining a better user fit, providing a higher level of safety to help reduce possible restrictions or limitations from being placed on potential users.

A third advantage being cylindrical handles for the saw nunchuck, that are weighed and matched for precision balance, to increase stability and consistency in movements, allowing easier control and more reliable handling for the user.

A fourth advantage being handles with a top end having a quarter rounded edge that substantially restricts surface contact and minimizes friction between flexible coupling and top face of the handles, thereby decreasing resistance to motion and wear on the flexible coupling.

A fifth advantage is a modernized procedure with a reduced production time for a connection system using a single cord configuration that substantially restricts and controls movement between the coupling and the inlet of the cylindrically shaped handles.

Another advantage is a flexible coupling with a larger diameter and a shorter length, having a kernmantle construction consisting of a separate internal nylon stranded core (kern) and external nylon woven sheath (mantle) for optimum strength, durability and performance.

Another advantage is a handle grip guide with an easy to find grip position for assisting precise and consistent hand placement, developing better control and more reliable handling.

Another advantage is a saw nunchaku assembly method having novel features that make it streamlined and cheaper to manufacture the saw nunchuck.

These along with other advantages of one or more aspects will be better understood by reading the following description in conjunction with reference to the accompanying drawings.

BRIEF DESCRIPTION OF THE SEVERAL VIEWS OF THE DRAWINGS

FIG. 6 is a detailed side cross-sectional view of the installed sleeve fastener.

FIG. 7 is a side cross-sectional view of the installed coupling anchor.

FIG. 8 is an enlarged sectional view of coupling anchor, showing area 8 from FIG. 7.

FIG. 8A is a front cross-sectional view of coupling anchor installed in FIG. 8.

TABLE OF NOMENCLATURE

Part No. Description

Figure 1:
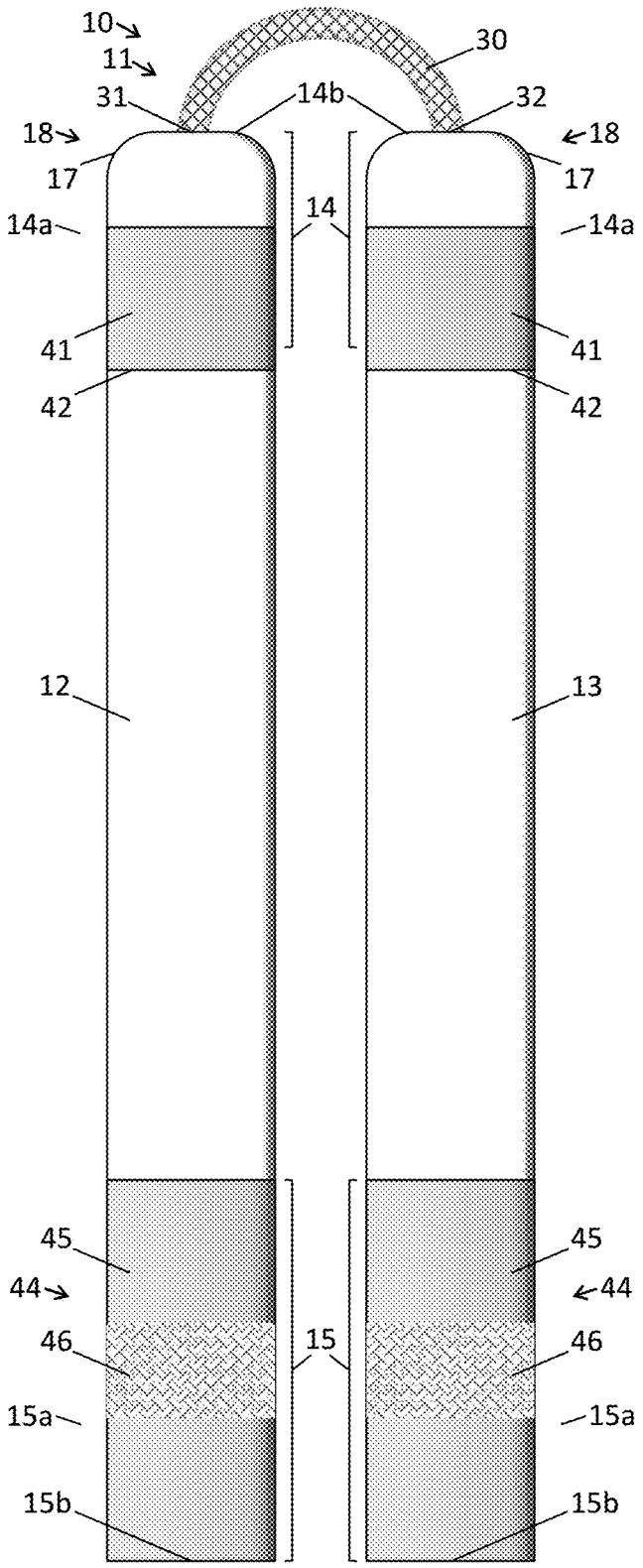
FIG. 1 is a front elevation view of saw nunchuck in accordance with one embodiment.

10 saw nunchaku assembly method
11 saw nunchuck
12 first grip handle or dowel rod
13 second grip handle or dowel rod
14 top end
14*a* top end side
14*b* top face
15 bottom end
15*a* bottom end side
15*b* bottom edge
16 straight edge cut
17 quarter rounded edge
18 connection system
20 connection component
22 coupling inlet
23 centered vertical blind hole
24 bevel edge (top)
26 coupling outlet

27 horizontal blind hole
28 bevel edge (side)
30 flexible coupling
31 first alike end
32 second alike end
33 anchor component
34 first coupling anchor
35 second coupling anchor
36 first sleeve fastener
37 second sleeve fastener
38 flared end
39 tapered end
40 melded fixed shape end
41 anchor support
42 handle grip guide
44 optical stripe
45 silver metal stripe
46 prismatic stripe
47 heat shrink tubing
48 vinyl wrap
49 mylar wrap

DETAILED DESCRIPTION OF ONE EMBODIMENT

In accordance with one embodiment, FIG. 1 depicts a saw nunchaku assembly method 10 for manufacturing a saw nunchuck 11, using saw process construction methods of precise and detailed adjustments, attaining refined foundational properties, enabling a better fit and functions for the saw nunchuck 11 and the user. The saw nunchaku assembly method 10 provides primary components comprised of a first and second grip handle 12, 13 and a cord or flexible coupling 30. Each of the first and second grip handles 12, 13 includes a top end 14 and a bottom end 15. Each top end 14 having a top end side 14*a* with a top face 14*b*, and each bottom end 15 having a bottom end side 15*a* with a bottom edge 15*b*. A quarter rounded edge 17 is machined on the top face 14*b* of each top end 14 to substantially restrict surface contact and minimize friction between the coupling 30 and the top face 14*b* of each first and second grip handle 12, 13. The quarter rounded edge 17 is designed to decrease resistance on motion and reduce the amount of physical exertion needed for movement during operation of the saw nunchuck 11.

A connection system 18 comprises components, which will be described in greater detail below, used in a single cord configuration to enclose and fix in position the coupling 30 having a first alike end 31 and a second alike end 32. The coupling 30 is joined to each of the first and second grip handles 12, 13 by accommodation of each first and second alike end 31, 32 within the top ends 14 and fixed in position at each of the top end side 14*a*, respectively. An anchor support 41 is used to further reinforce each of the first and second alike end 31, 32 at the top end side 14*a* of each first and second grip handle 12, 13. The anchor support 41 is designed to also function as a handle grip guide 42 including an easy to find grip position for assisting precise and consistent hand placement, providing a means for better control and more reliable handling during use of the saw nunchuck 11. Each of the bottom ends 15 includes an optical stripe 44 comprising a silver metal stripe 45 and a prismatic stripe 46 affixed on the bottom end side 15*a*, flush with the bottom edge 15*b* of each first and second grip handle 12, 13. The optical stripes 44 are designed to generate a variety of light reflections for improved ocular functions, providing a means for faster visual acquisition, better eye retention in visual tracking, and visual effects enhancing performance during use of the saw nunchuck 11.

Figure 2:
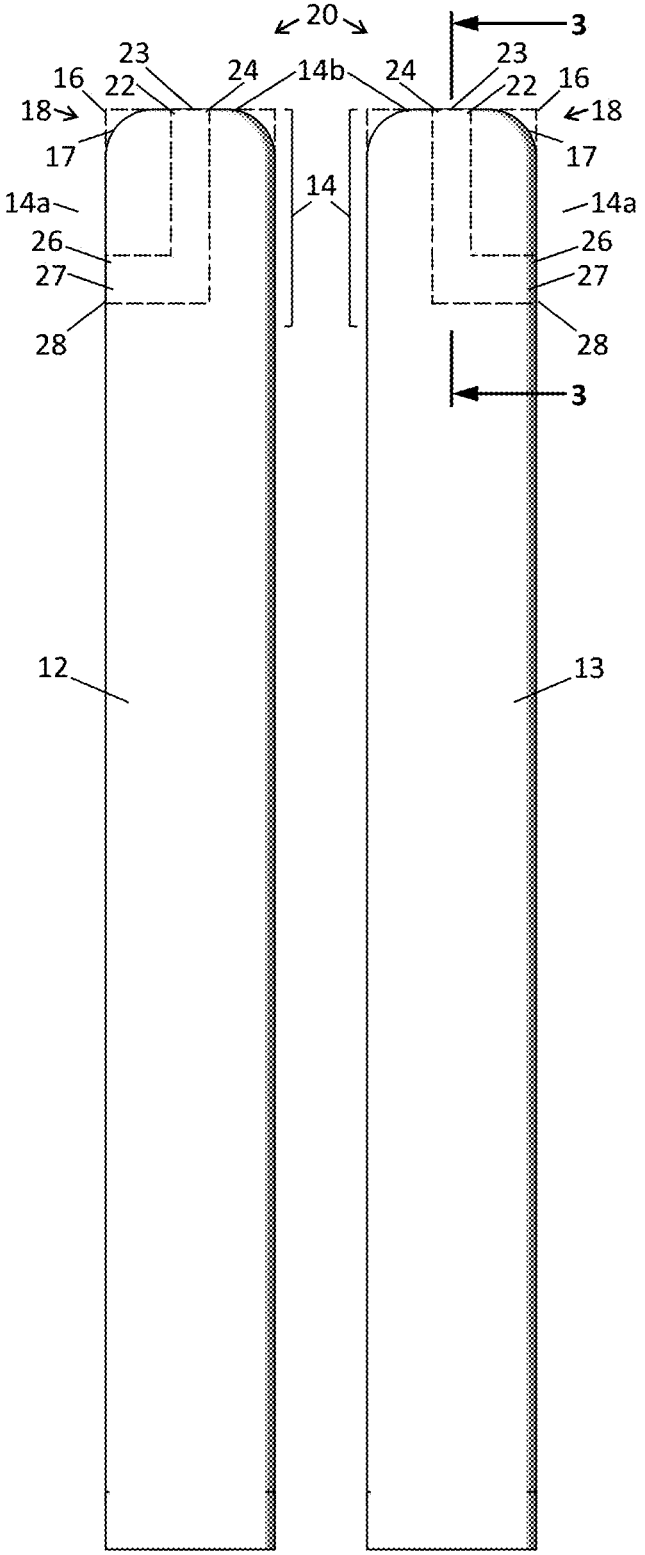
FIG. 2 is a front elevation view of the grip handles showing connection components.

FIG. 2 shows the grip handles 12, 13 constructed from wood dowel rod cut to equal lengths with a straight edge cut 16 and machined to quarter rounded edge 17 on the top face 14*b*. Each top end 14 of the grip handles 12, 13 is hollowed out with drilled holes for the connection system 18 accommodating a connection component 20 including a coupling inlet 22 and outlet 26. Each of the inlet 22 on the top face 14*b* having a centered vertical blind hole 23 with a bevel edge (top) 24; designed to substantially restrict and control movement between the flexible coupling 30 outside diameter and the inside diameter of inlets 22. Each of the outlets 26 at the top end side 14*a* having a horizontal blind hole 27 with a bevel edge (side) 28; designed for enclosing and fixing in position each first and second alike end 31, 32 of the flexible coupling 30 at the top end side 14*a* of each first and second grip handle 12, 13.

Figure 3:
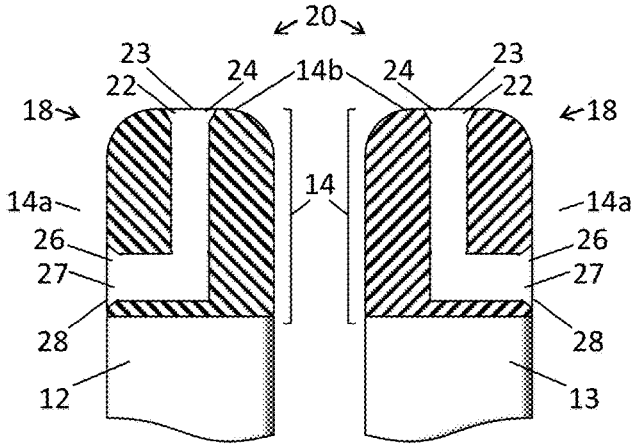
FIG. 3 is a side sectional view taken along the line 3-3 in FIG. 2.

Referring now to FIG. 3, a side cross-sectional view taken along the line 3-3 in FIG. 2 of the top end 14 on the first and second grip handles 12, 13 showing a better depiction of how the top end 14 has been hollowed out with drilled holes to accommodate the connection system 18. Each of the grip handles 12, 13 having the connection components 20 at the top face 14*b* that include the inlets 22 each comprising the centered vertical blind hole 23 with the bevel edge (top) 24, as well as the outlets 26 each comprising the horizontal blind hole 27 with the bevel edge (side) 28 at the top end side 14*a* of the grip handles 12, 13.

Figure 4:
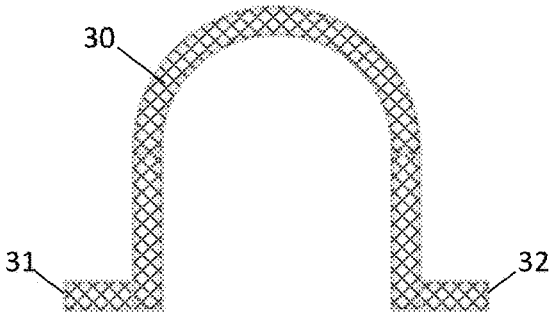
FIG. 4 is a side view of the uninstalled flexible coupling.

FIG. 4 is a side view of an uninstalled coupling 30 showing the coupling 30 having alike ends 31, 32 made of 4 mm nylon cord with kernmantle construction, available from Pigeon Mountain Industries (PMI) of LaFayette, Ga. Kernmantle is a cord built with an internal core (kern) and external sheath (mantle) made independent of each other. The internal core is built from continuous strands of nylon fibers that provide the tensile strength of the cord, while the external nylon woven sheath protects the core strands from damage.

Figure 5:
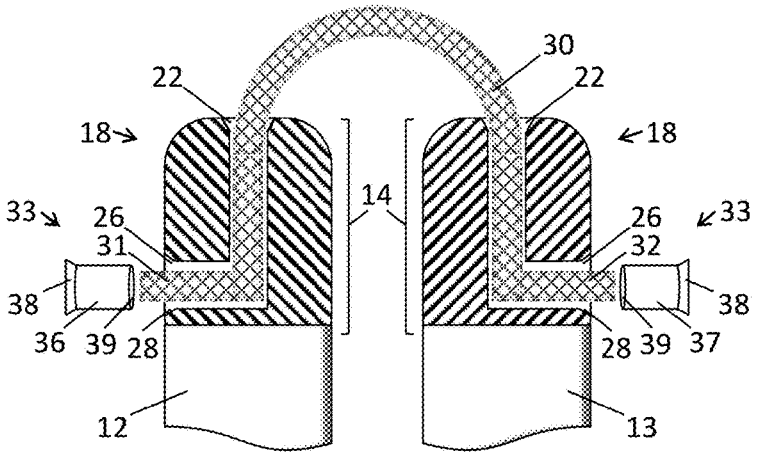
FIG. 5 is a side cross-sectional view of the installed flexible coupling.

FIG. 5, a side cross sectional view of an installed coupling 30 showing top end 14 of grip handles 12, 13 from FIG. 3, along with coupling 30 including alike ends 31, 32 from FIG. 4. Alike end 31 is entered at the inlet 22 on top face 14*b* and pulled beyond the outlet 26 at top end side 14*a* of grip handle 12. Alike end 32 is entered at the inlet 22 on top face 14*b* and pulled beyond the outlet 26 at top end side 14*a* of grip handle 13. The grip handles 12, 13 having an anchor component 33 at top end 14 including a first and second sleeve fastener 36, 37 each having a flared and tapered end 38, 39 designed to accommodate alike ends 31, 32 of the flexible coupling 30 within the coupling outlets 26. The tapered end 39 of the first fastener 36 is aligned with first alike end 31 at outlet 26 of grip handle 12; the tapered end 39 of the second sleeve fastener 37 is aligned with second alike end 32 at outlet 26 of grip handle 13.

FIG. 6 is a detailed side cross sectional view of the installed sleeve fastener 36, 37 showing top ends 14 of grip handles 12, 13 with anchor components 33 including a coupling anchor 34, 35. The first coupling anchor 34 on grip handle 12 includes first sleeve fastener 36 with tapered end 39 covering first alike end 31 of coupling 30; tapered end 39 is fitted tightly inside outlet 26 to prevent movement of fastener 36. Alike end 31 of the flexible coupling accepts a fixed end 40 pairing the inside size of the flared end 38 on first fastener 36. The second coupling anchor 35 on grip handle 13 includes second sleeve fastener 37 with tapered end 39 slipped covering second alike end 32 of the flexible coupling 30, and slidably snugly fitted tightly inside outlet 26. Alike end 32 of the flexible coupling 30 accepts a fixed end 40 pairing inside size of the flared end 38 on sleeve fastener 36. Fixed ends 40 are designed to be fitted tightly within the flared ends 38 of the sleeve fastener 36, 37 to prevent any movement of the alike ends 31, 32 on the flexible coupling 30.

FIG. 7 is a side cross sectional view of installed coupling anchors 34, 35, showing the coupling anchor 34 on grip handle 12 with sleeve fastener 36 having a fixed end 40 on alike end 31 of the flexible coupling 30 flush within the flared end 38. FIG. 7 also shows the coupling anchor 35 on grip handle 13 with sleeve fastener 37 having a fixed end 40 on alike end 32 of the coupling 30 flush within the flared end 38.

FIG. 8 is an enlarged sectional view of the coupling anchors 34, 35 showing area 8 from FIG. 7 comprising sleeve fastener 36, 37 having fixed ends 40 on alike ends 31, 32 of the coupling 30 flush within the flared ends 38, respectively.

Referring to FIG. 8A, a front cross-sectional view showing the front side of the installed coupling anchors in FIG. 7 with anchors 34, 35 comprising fastener 36, 37 having the fixed ends 40 of the flexible coupling 30 flush with the coupling outlets 26.

Figure 9:
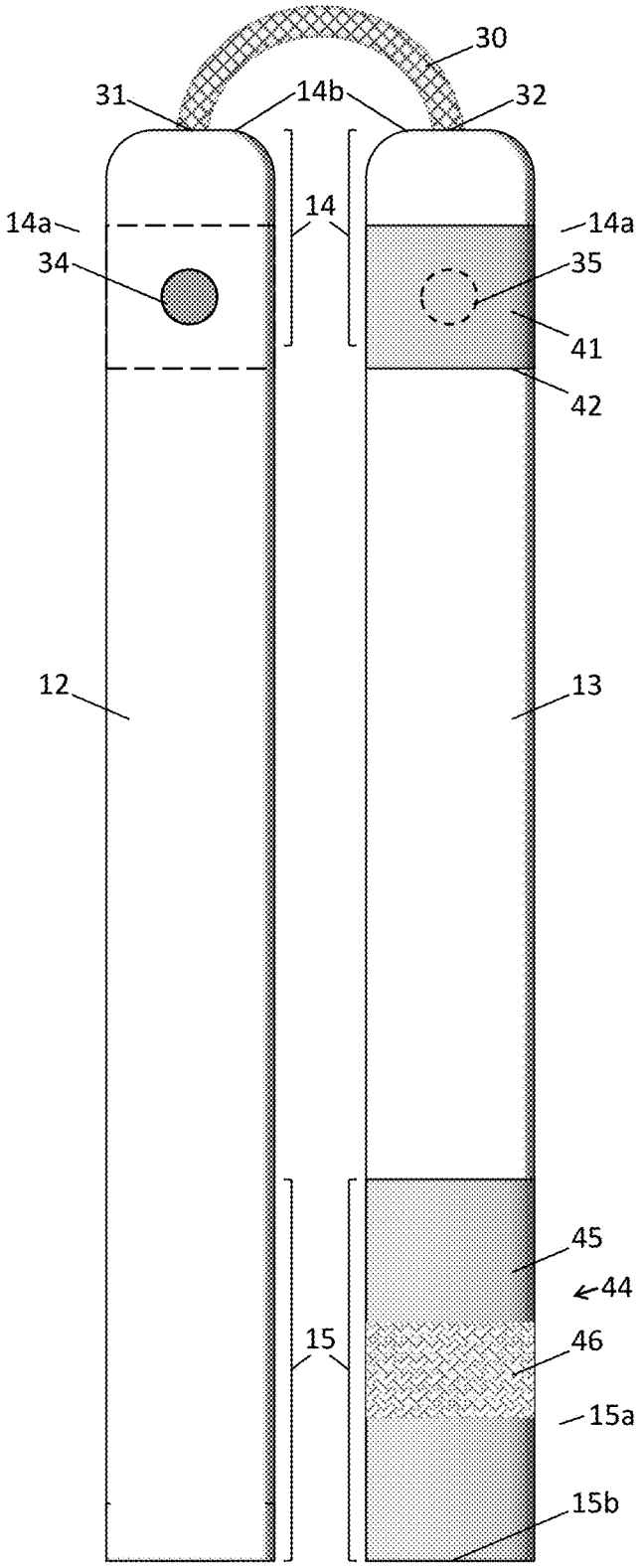
FIG. 9 is a front elevation view of the installed anchor support and optical stripe.

FIG. 9 is a front view of installed anchor support 41 and optical stripe 44; shows grip handles 12, 13 before and after install. Each of grip handles 12, 13 having top face 14*b* joined to flexible coupling 30 with alike ends 31, 32 fixed in position by coupling anchors 34,35 on top end side 14*a*. Grip handle 13 includes coupling anchor 35 and anchor support 41. Bottom end 15 comprises optical stripe 44 with silver metal stripe 45 and prismatic stripe 46 affixed on the bottom end side 15*a*, flush with the bottom edge 15*b*.

Operation

Referring to FIG. 1, a depiction of the saw nunchaku assembly method 10 shows the saw nunchuck 11 featuring primary components comprised of the first and second grip handles 12, 13 along with the flexible coupling 30 having first and second alike ends 31, 32.

The saw nunchaku assembly method 10 uses a metal lathe to provide a precision method for fabricating grip handles 12, 13 with an advanced construction wherein machining processes are minimized, and refined foundational properties are attained for a better fit and functions, providing higher levels of safety and precision performance, helping to facilitate accelerated development and improvement of skills for the user.

Each first and second grip handle 12, 13 comprises top and bottom ends 14, 15. Each of the top end 14 includes top end side 14*a* and top face 14*b* that is machined with quarter rounded edge 17 designed to substantially restrict surface contact and reduce friction between the coupling 30 and the top face 14*b* of each first and second grip handle 12, 13, thereby decreasing resistance on motion and wear on the coupling 30. Each top end 14 comprises connection system 18 using single cord configuration to enclose and fix in place the coupling 30. The connection system 18 includes each first and second alike end 31, 32 of the coupling 30 joining each of the first and second grip handle 12, 13 by attachment at each top face 14*b*, respectively. Each of the first and second alike end 31, 32 of the flexible coupling 30 is further reinforced with the anchor support 41 at the top end side 14*a* of each first and second grip handle 12, 13. The anchor support 41 also functions as handle grip guide 42 including easy to find grip position for assisting precise and consistent hand placement, providing the user a means for developing better control and more reliable handling during use of the saw nunchuck 11. Each of the bottom end 15 includes optical stripe 44 with silver metal stripe 45 and prismatic stripe 46 affixed on bottom end side 15*a*, flush with bottom edge 15*b*. Optical stripes 44 generate a variety of light reflections for improved ocular functions; providing a means for faster visual acquisition, better eye retention in visual tracking, and visual effects enhancing user performance.

Saw Process Methods—Construction Steps

Using saw process, first and second grip handles 12, 13—FIG. 1 are constructed from wood dowel rod having excellent characteristics: very lightweight, sturdy, great durability, and easy machinability. Lightweight wood produces less impact shock, reducing injury potential from accidental contact. Less exertion needed for movement, allowing easier control and more reliable handling, helping improve levels of safety and precision performance for the user.

1. First and Second Grip Handles 12, 13—FIG. 2—Sizing Method

Referring to FIG. 2, using saw process size specs for making saw nunchuck 11—FIG. 1 measuring 19.05 cm (7½ inches) in length and 2.22 cm (⅞ inch) diameter. First and second grip handles 12, 13 are constructed from wood dowel rod having a length of 121.92 cm (48 inches) by diameter of 2.22 cm (⅞ inch) cut to equal lengths with straight edge cut 16. The saw process uses a variety of standard handle sizes ranging from 25.4 to 30.48 cm (10 to 12 inch) lengths and 1.9 to 2.54 cm (¾ to 1 inch) diameters. The saw process handle sizes offer more options for a comprehensive means of accommodating users with a better fit based on user factors.

2. Quarter Rounded Edge 17—FIG. 2—Quarter Round Method

Referring again to FIG. 2, top face 14*b* of first and second grip handles 12, 13 having straight edge cut 16 machined with a radius of about 0.63 cm (¼ inch) to quarter rounded edge 17 so to substantially restrict surface contact and minimize friction between flexible coupling 30—FIG. 1 and top face 14*b*. The quarter rounded edge 17 enables better operation functions that help: minimize resistance on motion and wear on coupling 30; provide a smoother and more consistent rotation with less exertion needed for movement, allowing easier control and more reliable handling, facilitating increased levels of safety and precision performance for the user.

3. Drilling Inlets 33—FIG. 2—Connection Method

Referring to FIG. 2, the top end 14 of grip handles 12, 13 feature connection system 18 with connection components 20 including coupling inlets 22 at top face 14*b* having vertical blind hole 23 measuring about 2.54 cm (1 inch) length, and bevel edge 24 measuring about 0.63 cm (¼ inch) diameter. Using saw process, inlets 22 are specifically sized for the flexible coupling 30—FIG. 4 being fitted tightly within inlets 22 to substantially restrict and control movement between the flexible coupling 30 outside diameter and the inside diameter of the inlets 22: thereby decreasing resistance to motion and wear on coupling 30.

4. Drilling Outlets 26—FIGS. 2, 3—Connection Method

Connection components 20 also include coupling outlets 26 having horizontal bore blind hole 27 of about 1.27 cm (½ inch) length, and bevel edge 28 of about 0.79 cm (5/16 inch) diameter. The horizontal blind hole 27 is aligned end to end with vertical blind hole 23 at top end side 14*a* of each grip handle 12, 13. Using saw process, coupling outlets 26 are specifically sized for sleeve fastener 36, 37—FIG. 5 being fitted tightly within outlets 26 to fix in position the alike ends 31, 32 of the coupling 30. FIG. 3 is a side cross sectional view of top end 14 on grip handles 12, 13 taken along the line 3-3 in FIG. 2; providing a better depiction of connection components 20 at top face 14*b* including inlets 22 having vertical blind hole 23 with bevel edge 24 and outlets 26 having horizontal blind hole 27 with bevel edge 28 at top end side 14*a*.

5. Weighing Red Grip Handles 12, 13—FIG. 2—Precision Balance Method

Using the saw process, after completing Steps 1-4, grip handles 12, 13 are weighed individually and matched into pairs according to weight, using specified weight tolerance. If the weight of first or second grip handle 12, 13 doesn't meet tolerance standard, an adjustment is made with saw process for lowering higher weight of grip handle 12, 13 until it conforms to tolerance standard. This is done by drilling the centered vertical blind hole 23 deeper in small increments, gradually reducing the higher weight to correct matching weight. The precision balanced weight of grip handles 12, 13 helps provide increased stability and consistency in movements with less exertion, allowing easier control and more reliable handling for the user.

6. Preparing Flexible Coupling 30—FIG. 4—Connection Method

Referring to FIG. 4, flexible coupling 30 with alike ends 31, 32 are cut to length of about 10.16 cm (4 inches) from roll of at least 4 mm diameter nylon kernmantle cord. The cut alike ends 31, 32 of the coupling 30 are then melted to prevent the ends from fraying. Kernmantle cord has excellent flexibility, helping reduce contact friction on parts and resistance on motion.

7. Installing Flexible Coupling 30—FIG. 5—Connection Method

Referring to FIG. 5, shows cross sectional view of installed flexible coupling 30. Coupling 30 diameter is specifically sized to be fitted tightly within the coupling inlets 22. Alike end 31 of coupling 30 is entered into inlet 22 on top face 14*b* and pulled beyond outlet 26 at top end side 14*a* of grip handle 12. Alike end 32 is entered into inlet 22 on top face 14*b* and pulled beyond outlet 26 at top end side 14*a* of grip handle 13.

8. Installing Sleeve Fasteners 36, 37—FIGS. 5, 6—Anchor Method

Again referring to FIG. 5, grip handles 12, 13 feature anchor components 33 at top end 14 including sleeve fastener 36, 37 with flared and tapered end 38, 39. Sleeve fasteners 36, 37 are made from copper tubing having OD measurement specifically sized to be fitted tightly within outlets 26 and ID measurement specifically sized to alike ends 31, 32 being fitted tightly therein. Copper tubing is cut to length measuring about 0.95 cm (⅜ inch) and flared on one end using a pipe flaring tool. FIG. 5 also shows tapered ends 39 sleeve fasteners 36, 37 aligned with alike ends 31, 32 of coupling 30 at outlets 26, respectively.

FIG. 6 is a detailed side cross sectional view of installed sleeve fasteners 36, 37 at top ends 14 of grip handles 12, 13 having anchor components 33 coupling anchors 34, 35. Coupling anchor 34 on grip handle 12 includes tapered end 39 of fastener 36 covering alike end 31 of coupling 30, and fitted tightly within outlet 26 having bevel edge 28 flush with flared end 38 and glued. Coupling anchor 35 on grip handle 13 includes tapered end 39 of fastener 37 covering alike end 32, and fitted tightly within outlet 26 having bevel edge 28 flush with flared end 38 and glued. Each of alike ends 31, 32 accepts a fixed end 40.

9. Installing Coupling Anchors 34,35—FIG. 7—Anchor Method

FIG. 7 shows installed coupling anchor 34 on first grip handle 12 with first fastener 36 accepting fixed end 40 on first alike end 31 of flexible coupling 30 flush within flared end 38 and glued. The coupling anchor 35 on second grip handle 13 includes second fastener 37 accepting fixed end 40 on second alike end 32 flush within flared end 38 and glued.

The connection system 18 has three points of protection providing a secure and reliable method for a safer connection. Coupling outlets 26 are sized to anchors 34, 35 with flared and tapered ends 38, 39 glued within outlets 26. First point of protection is flared end 38; fixed ends 40 glued inside flared ends 38 to prevent movement. Second point is tapered ends 39 having alike ends 31, 32 of coupling 30 glued inside tapered ends 39 to prevent movement. Third point is inlets 22 sized smaller than tapered ends 39 of anchors 34, 35; locking tapered ends 39 and coupling 30 securely in place to prevent movement thereof.

10. Installing Anchor Support 41—FIG. 9—Anchor Method

FIG. 9 shows installed anchor support 41 on grip handle 13 comprising top end 14 having top face 14*b* joined to coupling 30 with alike end 32 being fixed in position by anchor 35 on top end side 14*a*. Anchor support 41 includes aluminum tape measuring about 1.9 cm (¾ inch) height and about 8.25 cm (3¼ inch) length, affixed over flared end 38 of anchor 35 to prevent movement thereof. Anchor support 41 also functions as handle grip guide 42 providing an easy find grip position for precise and consistent hand placement.

11. Installing Optical Stripes 44—FIG. 9—Optical Stripe Method

FIG. 9 also shows installed optical stripe 44 on bottom end 15 of grip handle 13 with the silver metal stripe 45 comprised of aluminum tape measuring about 5.08 cm (2 inch) height and 8.25 cm (3¼ inch) length, being affixed on the bottom end side 15*a* flush with bottom edge 15*b*. The prismatic stripe 46 comprised of prism tape measuring about 1.27 cm (½ inch) height and 8.25 cm (3¼ inch) length, being affixed on the bottom end side 15*a* over the center of the silver metal stripe 45. The optical stripe 44 generates a variety of light reflections for improved ocular functions and visual effects enhancing user performance.

The saw nunchaku assembly method 10—FIG. 1 for manufacturing the saw nunchuck 11 has been described in one embodiment, alternative embodiments may include:

- Instead of poplar wood, grip handles 12, 13—FIG. 2 can be made from other types of wood like pine, maple or oak.
- Materials like nylon 6/6, polycarbonate/other plastics or metals can be used to make the first and second grip handles 12, 13.
- First and second grip handles 12, 13 can be made with a different length and diameter.

FIG. 4 shows flexible coupling 30 with kernmantle construction:

- The flexible coupling can be made from some other type of material or construction method.
- Instead of using a 4 mm flexible coupling 30 it can change to a larger or smaller diameter.
- The flexible coupling 30 can be made to different lengths.
- The flexible coupling 30 can change to different colors and patterns.
- The flexible coupling 30 configuration for a single cord can change to a double cord.

FIG. 6 shows the first and second sleeve fastener 36, 37 used for coupling anchor 34, 35:

The first and second sleeve fastener 36, 37 can be changed to different sizes.

First and second sleeve fastener 36, 37—FIG. 6 can be made of other metals and plastics.

Figure 9A:
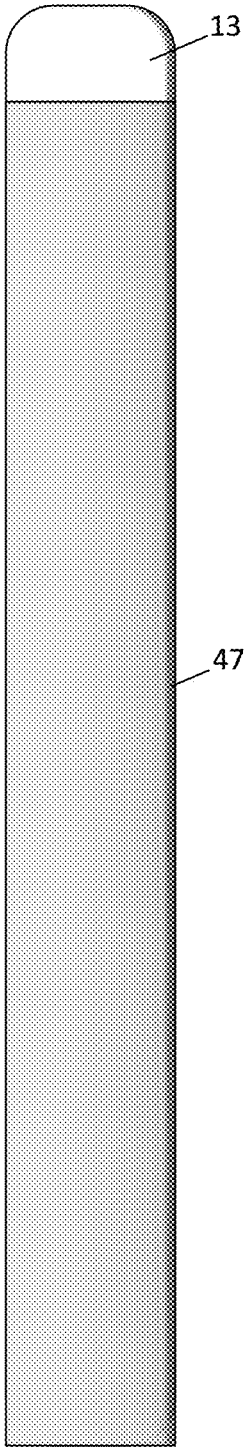
FIG. 9A to 9C are front views of grip handles in accordance with other embodiments.

FIG. 9 shows optical stripe 44 on second grip handle 13:

Optical stripe 44 can change to a heat shrink tubing 47—FIG. 9A with a variety of colors.

Figure 9B:
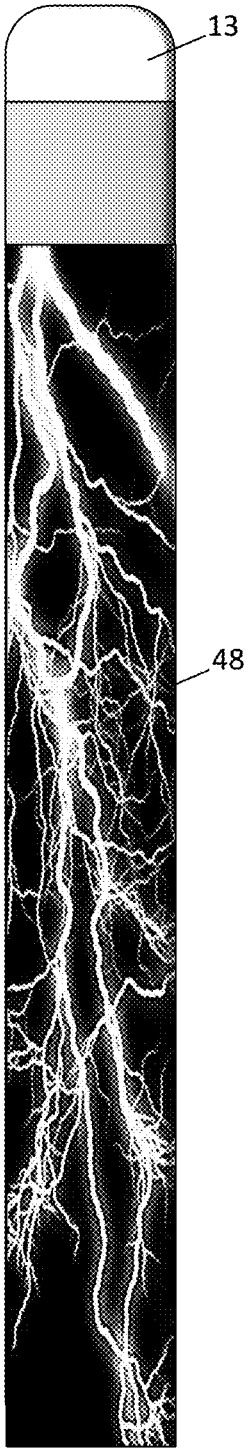

Optical stripe 44 can change to vinyl wrap 48—FIG. 9B with a variety of colors and designs.

Figure 9C:
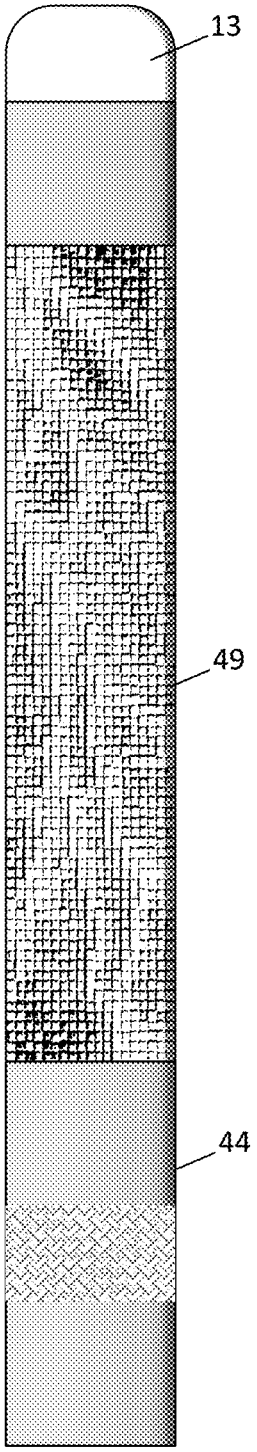

Optical stripe 44 can combine with mylar wrap 49—FIG. 9C in variety of colors and patterns.

Although the description above contains many specificities, these should not be construed as limiting the scope of the embodiments but as merely providing illustrations of some of several embodiments. Thus the scope of the embodiments should be determined by the appended claims and their legal equivalents, rather than by the examples given.

The invention claimed is:

1. A nunchaku assembly method for making a nunchuck comprising:

a first and second rod handle each including a top and bottom end, each said top end having a top end side and a top face, a bottom end having a bottom end side and a bottom edge;

a connect cord having a first and second cord end, each being linked within said top end of a relevant one of each said first and second rod handles, respectively;

a quarter rounded edge is machined on said top face of each said top end to reduce contact friction between said connect cord and each of said top face; said top end includes, a centered vertical bore hole on each said top face of said first and second rod handles slidably receives each of said first and second cord ends of said connect cord, threaded respectively into each of said centered vertical bore holes and extending out through a horizontal bore hole on each said top end side of said first and second rod handles, each said horizontal bore hole being specifically sized to slidably receive, a first and second tubular cord insert each including a flared and tapered end, said first tubular cord insert having said tapered end slipped over said first cord end of said connect cord, where said tapered end is slidably received and glued snugly inside of said horizontal bore hole on said top end side of said first rod handle; and said first cord end of said connect cord is heated to, a molded shape matching the inside size of said flared end on said first tubular cord insert, where said molded shape on said first cord end is slidably received and glued snugly inside of said first tubular cord insert flush within said flared end on said top end side of said first rod handle;

said second tubular cord insert having said tapered end slipped over said second cord end of said connect cord, where said tapered end is slidably received and glued snugly inside of said horizontal bore hole on said top end side of said second rod handle; and said second cord end of said connect cord is heated to, said molded shape matching the inside size of said flared end on said first tubular cord insert, where said molded shape on said second cord end is slidably received and glued snugly inside of said second tubular cord insert flush within said flared end on said top end side of said second rod handle;

an anchor support at said top end side of each said first and second rod handle, where said anchor support is affixed over said flared end of each said first and second tubular cord inserts said anchor support also functions as, a handle grip guide providing an easy to find grip position at each said top end side for assisting precise and consistent hand placement during operation of said nunchuck;

an optical stripe attached on each said bottom end of said first and second rod handles, said optical stripes including a silver metal stripe and a prismatic stripe affixed on said bottom end side, flush with said bottom edge, whereby said optical stripes produce a variety of light reflections for improved ocular functions and visual effects during operation of said nunchuck.

* * * * *